United States Patent [19]

Gundlach et al.

[11] Patent Number: 4,777,904

[45] Date of Patent: Oct. 18, 1988

[54] TOUCHDOWN DEVELOPMENT APPARATUS

[75] Inventors: Robert W. Gundlach, Victor; Richard F. Bergen, Ontario; Frank T. Lippolis, Ontario; William H. Wayman, Ontario, all of N.Y.

[73] Assignee: Xerox Corporation, Stamford, Conn.

[21] Appl. No.: 945,436

[22] Filed: Dec. 22, 1986

[51] Int. Cl.[4] ..... G03G 15/08

[52] U.S. Cl. ..... 118/653; 355/3 DD

[58] Field of Search ..... 355/3 DD; 118/656, 653, 118/657; 430/123, 120

[56] References Cited

U.S. PATENT DOCUMENTS

| | | | |
|---|---|---|---|
| 2,576,047 | 11/1951 | Schaffert | 101/426 |
| 2,902,974 | 9/1959 | Greaves | 430/123 X |
| 3,203,394 | 8/1965 | Hope et al. | 118/637 |
| 3,682,678 | 8/1972 | Moradzadeh et al. | 118/656 |
| 3,881,446 | 5/1975 | Kurita et al. | 118/657 |
| 3,941,084 | 3/1976 | Kurita | 118/657 |
| 4,083,326 | 4/1978 | Kroll et al. | 118/661 |
| 4,177,757 | 12/1979 | Murakawa et al. | 118/658 |
| 4,318,607 | 3/1982 | Bonham et al. | 118/657 |
| 4,370,056 | 1/1983 | Hays | 355/3 DD |
| 4,458,627 | 7/1984 | Hosono et al. | 118/657 |
| 4,481,903 | 11/1984 | Haberhauer et al. | 118/653 |
| 4,575,220 | 3/1986 | Sakamoto et al. | 355/3 DD |
| 4,583,490 | 4/1986 | Kan et al. | 118/658 |
| 4,624,545 | 11/1986 | Yasuda et al. | 355/3 DD |

FOREIGN PATENT DOCUMENTS

| | | | |
|---|---|---|---|
| 25642 | 2/1977 | Japan | 355/3 DD |
| 25323 | 9/1980 | Japan | 118/656 |
| 205381 | 6/1984 | Japan | 355/3 DD |
| 121472 | 6/1985 | Japan | 355/3 DD |
| 237879 | 7/1985 | Japan | 355/3 DD |

*Primary Examiner*—Shrive Beck
*Assistant Examiner*—Alain Bashore
*Attorney, Agent, or Firm*—William A. Henry, II

[57] ABSTRACT

A touchdown development system includes a donor roll positioned closely adjacent a photosensitive member in order to develop an image on the surface of the photosensitive member. A reverse mounted doctor blade is employed in the system along with a toner pump in order to apply a smooth and uniform layer of toner onto the surface of the donor roll.

9 Claims, 1 Drawing Sheet

TOUCHDOWN DEVELOPMENT APPARATUS

BACKGROUND OF THE INVENTION

This method and apparatus relates to electrostatic image development and more particularly to an improved xerographic method and apparatus for the development of electrostatic images by which a toner layer is presented to the latent image for development thereof.

In the reproduction process of xerography, a photoconductive surface is charged and then exposed to a light pattern of the information to be reproduced, thereby forming an electrostatic latent image on the photoconductive surface. Charged toner particles, which may be finely divided, pigmented, resinous material are presented to the latent image where they are attracted to the photoconductive surface. The toner image can be fixed and made permanent on the photoconductive surface or it can be transferred to another surface where it is fixed.

One known method of developing electrostatic latent images is by a process called transfer development. Transfer development broadly involves bringing a layer of toner to an imaged photoconductor where toner particles will be transferred from the layer to the imaged areas. In one transfer development technique, a layer of charged toner particles is applied to a donor member which is capable of retaining the particles on its surface and then the donor member is brought into close proximity to the surface of the photoconductor. In the closely spaced position, particles of toner in the toner layer on the donor member, are attracted to the photoconductor by the electrostatic charge on the photoconductor opposite to the toner charge so that development takes place. In this technique the toner particles must traverse an air gap to reach the imaged regions of the photoconducor. In the two other transfer techniques the toner-laden donor actually contacts the imaged photoreceptor and the minimum air gap is reduced to zero in the center of the nip. In one such technique, the toner-laden donor is rolled in non-slip relationship into and out of contact with the electrostatic latent image to develop the image in a single rapid step. In another such technique, the toner-laden donor is skidded across the xerographic surface. Skidding the toner by as much as the width of a thin line will double the amount of toner available for development of the line if it lies perpendicular to the skid direction. The amount of skidding can be increased to achieve greater density or greater area coverage.

It is to be noted, therefore, that the term "transfer development" is generic to development techniques where (1) the toner layer is out of contact with the imaged photoconductor and the toner particles must traverse an air gap to development, (2) the toner layer is brought into rolling contact with the imaged photoconductor to effect development, and (3) the toner layer is brought into skidding contact with the imaged photoreceptor eo effect development. Transfer development has also come to be known as "touchdown development."

In a typical transfer development system, a cylindrical or endless donor member is rotated so that its surface can be presented to the moving surface of a photoconductive drum bearing an electrostatic latent image thereon. Positioned about the periphery of the donor member are a number of processing stations including, a donor loading station, at which toner is presented to and coated on the donor member surface; an agglomerate removal station at which toner agglomerates and excess toner are removed from the toner layer retained on the surface of the donor member; a charging station at which a uniform charge is placed on the particles of toner retained on the donor surface; a clean up station at which the toner is converted into one of uniform thickness and uniform charge state at which any toner agglomerates not removed by the agglomerate removal station are removed, a development station at which toner particles carried by said donor member are presented to the imaged photoconductor for image development; and a cleaning station at which a neutralizing charge is placed upon the residual toner particles and at which a cleaning member removes residual toner from the peripheral surface of the photoreceptor. In this manner, a continuous development process is carried out.

Among the donor members employed in the prior art are those embodying the principles described in U.S. Pat. No. 3,203,394. Such a donor includes, an electrically conductive support member in the form of a cylinder, a thin electrically insulating layer overlying a support member, and a continuous, electrically conductive screen pattern is provided. An electrical connection to a slip ring is provided so that its potential may be varied between ground potential and a charge potential at different stages of process. A multitude of high fringe fields or microfields are created at the surface of this type of donor member. When this type of donor member is brought into contact with toner particles, it is in this manner loaded with toner.

A donor member of this type is quite expensive to manufacture, it is quite fragile in the screen regions and is subject to be electrically disabled, e.g., through shorting of the screen to the conductive substrate, unless considerable care is taken during its manufacture and use.

The art of xerographic development, and in particular transfer development, would be significantly advanced if a simpler and more reliable uniform loading of the donor member and reloading in a single pass after large solid image areas have been developed out as well as a less costly system were available.

Doctor blades have been used extensively in the past for loading donors with charged toner. The blades usually are positioned at a 9 o'clock position extending toward the 11 o'clock position of a donor member and have a pointed end directed toward the surface of the donor member in order to load toner onto the surface of the donor member. In practice, large agglomerates or other debris will be wedged into the nip formed between the doctor blade and the donor member and cause streaks in the toner layer formed on the donor member.

In order to get away from this particular problem, a number of prior art devices switched to magnetic toner touchdown development with the use of magnetic donor rolls and magnetic toner. For example, Japanese Patent Document No. 52-25642 appears to show a development device that supplies a mass of toner smoothly to a developer roll by swinging a magnetic piece in a hopper due to a rotating magnetic field of a magnet roll. U.S. Pat. No. 4,370,056 discloses a belt development system which incorporates a metering blade and a paddle wheel which advances developer material to a developer roll. The metering blade is positioned to trim toner to a certain height on a toner transport belt once a strong magnetic field has been applied to the toner. A development apparatus that forms a thin toner layer on the surface of a non-magnetic sleeve that covers a fixed magnet is shown in U.S. Pat. No. 4,583,490. A magnetic blade is inclined with respect to a line normal to the surface of the sleeve in order to trim a mixture of non-magnetic and magnetic toner to a desired height on the sleeve. In U.S. Pat. No. 4,177,757, a magnetic brush development device is disclosed that incorporates multiple magnetic brushes to deliver toner to a development zone and a doctor blade for controlling the thickness of toner pumped up to the brushes. U.S. Pat. No. 4,575,220 shows a developing device in which a pressure blade is firmly pressed against a sleeve of a magnetic donor roll. The blade is comprised of a magnetic material and is magnetically attracted to a magnet disposed inside the sleeve. These magnetic development systems are cumbersome and costly and have been found to be not entirely satisfactory.

SUMMARY OF THE INVENTION

Accordingly, the present invention is directed to a new concept for loading a donor member with a simple and uncomplicated apparatus and process which includes turning the doctor blade around so that its leading edge "cuts" a blanket of toner at the desired thickness. By turning the doctor blade around, any agglomerates or particles too large to slide under the blade's leading edge are rejected from entry into the nip and returned to the toner sump. The blade thus accurately controls toner thickness on the donor member, depending on its inward pressure against the donor member and protrusion past its tangent point with the donor member.

For a better understanding of the invention as well as further features thereof, reference is made to the accompany drawings, wherein:

DESCRIPTION OF THE PREFERRED EMBODIMENTS

The present invention is a transfer development system and method in which toner particles are applied to an electrostatic latent image on a photoconductive plate to develop the image. Although the system and method is described herein as part of a xerographic copier, it can be utilized in conjunction with any reproduction system wherein a latent image is to be developed by applying toner thereto, e.g., a latent image in an electrographic system or a xeroprinting system as shown in U.S. Pat. No. 2,576,047.

Figure 1:
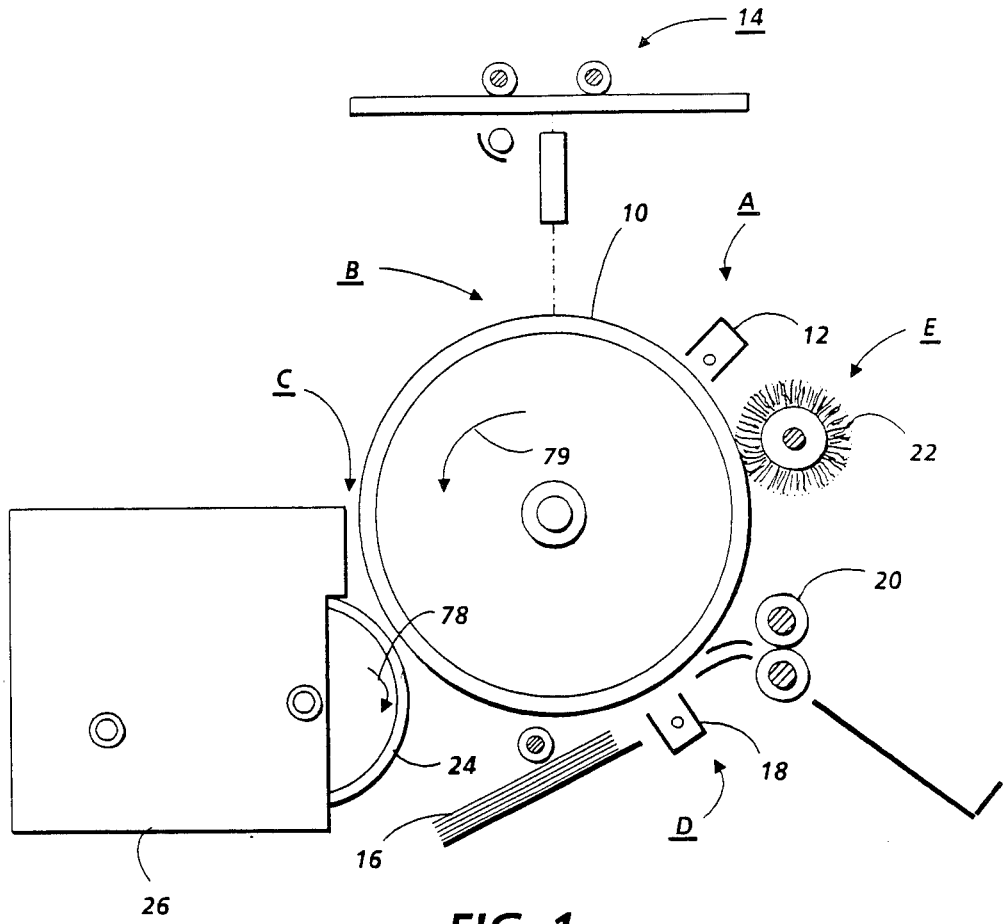
FIG. 1 is a sectional view of an exemplary xerographic apparatus employing the present invention.

Referring to FIG. 1, there is shown a xerographic reproduction system utilizing the concept of the present invention. In this apparatus a xerographic plate is in the form of a drum 10 which passes through stations A–E in the direction shown by arrow 79. The drum has a suitable photosensitive surface, such as one including selenium overlying a layer of conductive material, on which a latent electrostatic image can be formed. The various stations about the periphery of the drum which carry out the reproduction process are: charging station A, exposing station B, developing station C, transfer station D, and cleaning station E. Stations A, B, D and E represent conventional means for carrying out their respective functions. Apart from their association with the novel arrangement to be described with respect to station C they form no part of the present invention.

At station A, a suitable charging means 12, e.g., a corotron, places a uniform electrostatic charge on the photoconductive material. As the drum rotates, a light pattern, via a suitable exposing apparatus 14, e.g., a projector, is exposed onto the charged surface of drum 10. The latent image thereby formed on the surface of the drum is developed or made visible by the application of a finely divided pigmented, resinous powder called toner at development station C, which is described in greater detail below. After the drum is developed at station C, it passes through transfer station D, comprising copy sheet 16, corona charging device 18 and fuser device 20. Following transfer and fixing of the developed image to the copy sheet, the drum rotates through cleaning station E, comprising cleaning device 22, e.g., a rotating brush.

At developing station C, the apparatus includes a donor member 24 rotatably mounted adjacent a toner housing or reservoir 26 containing a supply of toner 28. The donor member or roll 24 is positioned so that a portion of its periphery comes into contact with toner 28. The donor roll is also located so as to contact the surface of drum 10 or come into range for toner to present the outer surface of a toner layer carried by donor roll 24 to the drum.

Figure 2:
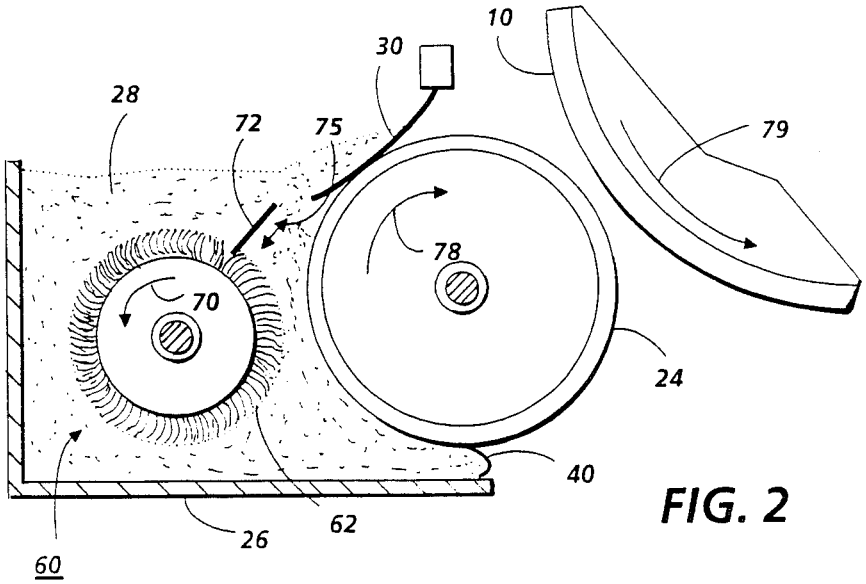
FIG. 2 is an enlarged sectional view of the donor development apparatus shown in FIG. 1.

Referring now to FIG. 2, there is shown a development system of the type contemplated by the present invention. Donor member 24, which in this case is a cylindrical anodized aluminum drum, is positioned so that a portion of its periphery may be rotated into contact or interactive propinquity with a mass of toner particles 28 in a toner housing or reservoir 26 that has a seal member 40 positioned to prevent toner from escaping from the housing. Located between photoreceptor 10 and toner pump 60, donor member 24 rotates in the direction of arrow 78 and carries toner into contact or transfer range with photoreceptor 10. A toner pump 60 is positioned in sump housing 26 and arranged to maintain pressure on toner 28 throughout the region of about 6 o'clock through doctor blade 30 at about the 11 o'clock position, with the return path throttled between interference blade 72 and the lead edge of doctor blade 30. The sump housing could be placed in a number of different positions as long as the toner is supplied to the donor roll and blade region. Interference blade 72 is adjustable in the direction of arrow 75 in order to assist toner pump 60 in maintaining a uniform pressure head at the doctor blade and donor member. In addition, the flicking action of the interference blade impeding the rotation of bristles 62 causes toner 28 to remain soft and fluffy without caking and thereby enhances the maintaining of a uniform and free flow of toner between the doctor blade and donor member. The toner 28 is charged by shearing action between doctor blade 30 and donor member 24. Doctor blade 30 is positioned to accurately control the thickness of toner placed on the surface of donor member 24 by extending from a point at about the 12 o'clock position of the donor member to and beyond a tangent point at about the 11 o'clock position of the donor member. A portion of the lead edge of the doctor blade extends beyond the tangent point and forms a lip overlap with the donor member.

The degree of overhang or lip that extends past the tangent point determines how much toner will be carried into the nip formed between the donor member and the portion of the doctor blade that extends beyond the tangent of the doctor blade with the donor member. The doctor blade is lightly loaded against the donor member such that this pressure along with the overhang of the doctor blade determines the thickness of single component non-magnetic toner placed on the donor member. A normal force can be applied to the doctor blade 30 by any conventional means in order to place the desired pressure onto donor member 24. An advantage to applying a light normal force to the doctor blade is that once a fixed normal force is applied, blade flexing will allow donor runout to be accommodated. It has been found that a practical working latitude of normal force exists; limited on the high end by the fact that clumps of toner weld to the doctor blade under excessive pressure, which produces narrow streaks in the toner layer on the donor surface. The lower limit is the point at which the thin blade fails to conform to the donor surface, and broad streaks of excessive toner loading are evident. This will depend on the flexibility of the doctor blade. For example, an optimum condition was found to comprise a normal force of about 0.01 lbs. per lineal inch applied to a blade of about 2 mils thickness with the blade hinged about ⅜ inch from the tangent point with the donor. Preferably, the blade is made of tempered steel shim stock.

An alternative means of applying a uniform layer of toner onto the surface of donor member 24 is to vary the normal force applied to the doctor blade 30 as a function of time, such as, by a cam on the drive shaft of the donor member whereby the normal force is increased and decreased and maximum and minimum values are not exceeded. This would assist in placing a uniform toner layer onto the surface of the donor member.

Toner pump 60 is positioned within housing 26 and has bristles 62 that are rotated in the direction of arrow 70 in order to insure that the toner 28 does not compact or cake and to drive toner toward doctor blade 30. An adjustable interference blade 72 is adapted to interfere with bristles 62 and thereby maintain mixing of the toner and to adjust the distance between interference blade 72 and doctor blade 30 to insure the desired throat pressure and rate of flow of the toner between the two blades. Interference blade 72 is adjustable in the direction indicated by arrow 75. Toner pump 60 provides a cost effective means for transporting toner with a low speed rotating brush or rotator with flexible paddles. Toner is fluffed up by action of the brush, which prevents binding and compacting. An optional cleaning blade (not shown) could be added to housing 26 adjacent donor 24 at about the 7 o'clock position in order to reduce the possibility of "ghosting", if necessary. Also, an optimum toner pump or brush was found to comprise bristles about 0.08 inches in diameter, about 0.3 inches long and spaced in tufts of three or four bristles at about 3/32 inch on center. The bristles can be made of polypropylene or the like.

In operation, as the donor member 24 rotates in the direction of arrow 78 as shown in FIG. 1, toner contacts the donor member at approximately the 180° position. By just filling toner housing 26 with one component toner with an additive to reduce toner adhesion and help toner flow, such as, aerosil to about the 9 o'clock position, very little toner will adhere to the donor member since its charge will be much too low. However, by frictionally loading doctor blade 30 against the donor member, the toner is triboelectrically charged by the associated raking action of the toner against the donor member. The nip between the tip of the doctor blade and a portion of the surface of the donor member forms a smooth blanket of toner on the donor member for transfer to the photoreceptor without agglomerates building up under the blade tip. Continued rotation of the donor member brings the toner now loaded onto its outer surface into contact or transfer range with an oppositely charged latent image on photosensitive member 10 whereby toner is transferred from the donor member to latent images on the photosensitive member for subsequent transfer to copy paper 16 by the use of transfer corotron 18.

In summary, a "touchdown development" system is disclosed that uses the lead edge of a reverse mounted doctor blade in combination with a toner pump to deliver charged toner into a development nip in order to uniformly coat a donor member surface. The doctor blade is used in a scraping orientation with the toner pump to assist in controllably, loading and charging a toner layer such that a good supply of toner is maintained on the donor member. The blade protrudes slightly beyond its contact point with the donor member to form a toner entry zone. The toner is delivered gently against the donor member and into the entry zone by the revolving brush. The protrusion of the doctor blade and its orientation prevents large particles and agglomerates from getting into the nip and causing streaks in the donor layer.

It is to be understood while for purposes of illustration the donor member has been described basically as a cylinder, it may be an endless belt adapted to deliver toner from the toner source to the several stations.

Conventional drive means, e.g., motors, belts, etc. are employed to drive the several movable members all in the manner within the skill of the art.

Since many changes can be made in the above construction and many apparently widely different embodiments of this invention can be made without departing from the scope thereof it is intended that all matter contained in the drawings and specification should be interpreted illustratively and not in a limited sense.

What is claimed is:

1. An electrostatic development apparatus for developing latent electrostatic images on an electrostatic latent image surface that is adapted to move in a predetermined direction, comprising;

a donor member closely spaced from said electrostatic latent image surface and adapted to apply single component, non-magnetic toner to said electrostatic latent image surface;

housing means adapted to be filled to a prdetermined level with single component non-magnetic toner and positioned adjacent said donor member for loading said toner onto said donor member for electrostatic transfer to said electrostatic latent image surface;

a reverse mounted doctor blade having a forward tip portion that extends downward beyond a tangent point with said donor member to form a nip therebetween so that toner passing upward through said nip will form a smooth and uniform layer of predetermined thickness on the surface of said donor member for transport to said electrostatic latent image surface;

toner pump means, said toner pump means including a brush having flexible bristles that insure that toner does not compact or cake and drive toner toward said reverse mounted doctor blade; and adjustable interference blade means that in conjunction with said brush maintains a uniform pressure head within a wedge formed between said reverse mounted doctor blade and said donor member, said adjustable interference blade means being positioned to interfere with said flexible fibers of said brush of said toner pump means in order to maintain mixing of the toner and to adjust the distance between said adjustable interference blade means and said reverse mounted doctor blade in order to insure desired throat pressure and rate of flow of toner between said adjustable interference blade means and said reverse mounted doctor blade.

2. The apparatus of claim 1, wherein said doctor blade is lightly loaded against the surface of said donor member.

3. The apparatus of claim 2, wherein said tip portion of said doctor blade that extends beyond said tangent point with said donor member comprises an overlap portion.

4. The apparatus of claim 2, wherein said doctor blade is loaded against the surface of said donor member with a normal force of about 0.01 lbs. per lineal inch.

5. The apparatus of claim 4, wherein said doctor blade is hinged about $\frac{3}{8}$ inch from the tangent point with said donor member.

6. The apparatus of claim 5, wherein said doctor blade is comprised of tempered steel shim stock of about 2 mils in thickness.

7. The apparatus of claim 1, wherein said bristles are about 0.08 inches in diameter, about 0.3 inches in length and are spaced in tufts of three or four bristles at about 3/32 inch on center.

8. The apparatus of claim 7, wherein said bristles are made of polypropylene.

9. An electrostatic development apparatus for developing latent electrostatic images on an electrostatic latent image surface that is adapted to move in a predetermined direction, comprising;

a donor member closely spaced from said electrostatic latent image surface and adapted to apply single component, non-magnetic toner to said electrostatic latent image surface;

housing means adapted to be filled to a predetermined level with single component non-magnetic toner and positioned adjacent said donor member for loading said toner onto said donor member for electrostatic transfer to said electrostatic latent image surface;

a reverse mounted doctor blade having a forward tip portion that extends downward beyond a tangent point with said donor member to form a nip therebetwen so that toner passing upward through said nip will form a smooth and uniform layer of predetermined thickness on the surface of said donor member for transport to said electrostatic latent image surface, and wherein the toner within said housing means is at least above a contact point between said reverse mounted doctor blade and said electrostatic latent image surface;

toner pump means, said toner pump means including a brush having flexible bristles that insure that toner does not compact or cake and drive toner toward said reverse mounted doctor blade; and adjustable interference blade means that in conjunction with said brush maintains a uniform pressure head within a wedge formed between said reverse mounted doctor blade and said donor member, said adjustable interference blade means being positioned to interfere with said flexible fibers of said brush of said toner pump means in order to maintain mixing of the toner and to adjust the distance between said adjustable interference blade means and said reverse mounted doctor blade in order to insure desired throat pressure and rate of flow of toner between said adjustable interference blade means and said reverse mounted doctor blade.

* * * * *